US009867509B2

(12) United States Patent
Hlushchenko et al.

(10) Patent No.: US 9,867,509 B2
(45) Date of Patent: Jan. 16, 2018

(54) DISPENSER WITH CAPACITIVE-BASED PROXIMITY SENSOR

(71) Applicant: San Jamar, Inc., Elkhorn, WI (US)

(72) Inventors: Kostyantyn Hlushchenko, Lviv (UA); Taras Hrabovenskyy, Lviv (UA)

(73) Assignee: San Jamar, Inc., Elkhorn, WI (US)

( * ) Notice: Subject to any disclaimer, the term of this patent is extended or adjusted under 35 U.S.C. 154(b) by 328 days.

(21) Appl. No.: 14/351,672

(22) PCT Filed: Oct. 15, 2012

(86) PCT No.: PCT/US2012/060267

§ 371 (c)(1),
(2) Date: Apr. 14, 2014

(87) PCT Pub. No.: WO2013/059127

PCT Pub. Date: Apr. 25, 2013

(65) Prior Publication Data

US 2014/0312158 A1 Oct. 23, 2014

Related U.S. Application Data

(60) Provisional application No. 61/547,531, filed on Oct. 14, 2011.

(51) Int. Cl.
*A47K 10/36* (2006.01)
*A47K 10/34* (2006.01)

(52) U.S. Cl.
CPC ..... *A47K 10/36* (2013.01); *A47K 10/34* (2013.01); *A47K 10/3612* (2013.01);
(Continued)

(58) Field of Classification Search
CPC .... A47K 10/36; A47K 5/1217; Y10T 225/30; Y10T 225/238; Y10T 225/12;
(Continued)

(56) References Cited

U.S. PATENT DOCUMENTS 6,412,855 B1 7/2002 Blatz
6,710,606 B2 * 3/2004 Morris ..... A47K 10/36 324/207.12

(Continued)

FOREIGN PATENT DOCUMENTS

EP 1297770 A1 4/2003
WO 2007098419 A2 8/2007

(Continued)

OTHER PUBLICATIONS

International Search Report and the Written Opinion of the International Searching Authority, or the Declaration; dated May 15, 2013—(16) Pages.

(Continued)

*Primary Examiner* — William A. Rivera
(74) *Attorney, Agent, or Firm* — Boyle Fredrickson, S.C.

(57) ABSTRACT

A dispenser assembly for web materials includes an enclosure that is configured to support a roll of material and a feed mechanism configured to dispense the material from the assembly. A capacitive sensor is connected to the feed mechanism and configured to allow touch-less operation of the dispenser. Operation of the sensor is adjustable so that the assembly can achieve a desired operation in environments having different capacitive backgrounds.

25 Claims, 9 Drawing Sheets

(52) U.S. Cl.
CPC .. *A47K 10/3625* (2013.01); *A47K 2010/3668* (2013.01); *Y10T 29/49018* (2015.01); *Y10T 29/49826* (2015.01)

(58) Field of Classification Search
CPC ..... Y10T 225/205; Y10T 225/209; Y10T 225/268; Y10T 225/232; B65H 35/10
See application file for complete search history.

(56) References Cited

U.S. PATENT DOCUMENTS

| | | | | |
|---|---|---|---|---|
| 6,903,654 | B2 * | 6/2005 | Hansen | A47K 10/36 242/563 |
| 6,977,588 | B2 * | 12/2005 | Schotz | A47K 10/36 242/570 |
| 7,161,359 | B2 * | 1/2007 | Denen | H05F 3/02 324/662 |
| 7,726,599 | B2 * | 6/2010 | Lewis | A47K 5/06 242/563 |
| 7,837,077 | B2 * | 11/2010 | Formon | A47K 10/36 225/6 |
| 8,395,396 | B2 * | 3/2013 | Hagleitner | A47K 5/1217 318/794 |
| 2006/0054733 | A1 | 3/2006 | Moody et al. | |
| 2008/0190982 | A1 | 8/2008 | Omdoll | |
| 2012/0061415 | A1 * | 3/2012 | Hagleitner | A47K 5/1217 221/1 |

FOREIGN PATENT DOCUMENTS

| | | | |
|---|---|---|---|
| WO | 2010121276 | A1 | 10/2010 |
| WO | 2011109063 | A1 | 9/2011 |
| WO | 2012174630 | A1 | 12/2012 |

OTHER PUBLICATIONS

Examination Report under Section 18(3) dated Jan. 31, 2017, Patent Application No. GB1406797.9—(5) pages.

* cited by examiner

DISPENSER WITH CAPACITIVE-BASED PROXIMITY SENSOR

CROSS-REFERENCE TO RELATED APPLICATIONS

This application is a non-provisional patent application and claims priority to U.S. Provisional Patent Application Ser. No. 61/547,531 filed on Oct. 14, 2011 titled "Roll Dispenser with Capacitative-Based Proximity Sensor".

BACKGROUND OF THE INVENTION

This invention relates generally to dispensers for dispensing material. More particularly, this invention relates to a hands-free or contactless roll dispenser for dispensing paper towels.

Dispensers for rolls of flexible sheet material, such as paper toweling, have been employed for many years. Such dispensers are widely used in public lavatories to dispense paper toweling for users to dry their hands. Typically, a roll of sheet material is rotatably supported inside a dispenser cabinet. In manually operated devices, a user manually actuates a lever that drives a feed mechanism configured to dispense the sheet material beyond the confines of the cabinet. The feed mechanism typically includes a drive roller and an idle roller. The lever interacts with the drive roller so that actuation of the lever rotates the drive roller. Rotation of the drive roller acts to unwind material from the material roll. One such dispenser is described in U.S. Pat. No. 7,168,653, the disclosure of which is incorporated herein.

U.S. Pat. No. 7,168,653 describes a web material dispenser having a front-mounted hand crank or handle that, when pushed/pulled downward, causes sheet material to be advanced from the roll and thereby dispensed from the dispenser. U.S. Patent Application Publication No. 2012/0181371, the disclosure of which is also incorporated herein, describes another roll dispenser having a hand crank or handle that is side-mounted relative to the dispenser but, when pushed/pulled downward, also causes sheet material to be advanced from the roll. Such dispensers require direct interaction with the hand of the user or those nearby, such as a parent, to effectuate operation of the advancement and feed mechanisms associated with dispensing the sheet material from the dispenser.

The dispensers described in the above-referenced patent documents, as well as other manually activated dispensers, have a lever mounted to or extending from areas proximate the front of the respective dispenser. The lever interfaces with a feed mechanism such as a drive roller such that, operation of the lever—whether being pushed or pulled in an upward, downward, or forward direction, actuates the drive roller which in turn advances the roll of sheet material. Dispensers of this nature are generally referred to as manual dispensers and require a user to place a hand (or portion thereof) on the lever to advance sheet material from the roll.

Increasingly, users are reluctant to have their hands contact such dispensers in an effort avoid contact with possible contagions associated with prior users of the respective dispensers. As a result, many users find such hand lever operated towel dispensers unacceptable and frustratingly such that some intended users have a tendency to exit lavatories without drying their hands. Other users, still attempting to avoid any possible contagions but unwilling to leave the lavatory with wet hands, attempt to engage the lever of the dispenser with portions of the body other than the palm and fingers of a hand, such as their arm, elbow, or the dorsal side of their hand. While some users have been able to effectuate operation of the dispenser with such strained effort, for many users and dispensers it is difficult, if not impossible, to effectuate operation of the manual advancement mechanism with anything other than the palm and fingers of a hand of a user.

One solution to overcome the undesired contact with such manually operated roll material dispensing systems has been the implementation of so-called "contactless" dispensers. Such dispensers commonly use one or more proximity sensors that detect the presence of a hand of a user relative to the dispenser and include a motorized feed assembly that advances or dispenses the sheet material. Contactless dispensers are not without their respective drawbacks. The electronic detection and motorized feed mechanisms can be expensive to acquire and implement and can include sensitive sensors intended to prevent unintended activation and/or operation of the dispensing system. As such, currently available electronic contactless or "hands-free" dispensers may not provide the desired operability and/or be an economically viable solution in some situations and/or desired implementations of such devices.

Accordingly, there is a need for a lower cost dispenser that allows the user to dispense the material from the dispenser in a manner that requires no direct physical interaction between the user and any portion of the dispensing system.

SUMMARY OF THE INVENTION

The present invention provides a low-cost, contactless dispenser assembly that overcomes one or more of the drawbacks discussed above. According to one aspect of the present invention, a dispenser assembly for web material is provided that includes an enclosure that is configured to support a roll of web material and a feed mechanism configured to dispense the sheet material from the assembly. A capacitive sensor is connected to the feed mechanism and configured to allow touch-less operation of the dispenser. Operation of the sensor is adjustable so that the assembly can achieve a desired, operation in environments having different capacitive background interferences.

Another aspect of the invention that it is usable with one or more of the above aspects discloses a dispenser assembly having an enclosure that is adapted to hold a supply of web material. The enclosure includes an opening through which the web material can be dispensed. A capacitive sensor that has a sensing zone is operative to detect the presence of an object within the sensing zone and a drive mechanism advances the web material when the sensor detects movement of an object within the sensing zone.

Another aspect of the invention that is useable or combinable with one or more of the aspects disclosed above includes a web material dispenser having an enclosure and a feed mechanism contained in the enclosure. The feed mechanism is configured to cooperate with a roll of a sheet material such that operation of the feed mechanism dispenses the sheet material beyond the enclosure. The dispenser includes a sensor that is operative to detect presence of an object in a sensing zone. An antenna is connected to the sensor but disposed outside the enclosure and a control is connected to the sensor and configured to manipulate sensitivity of the sensor as a function of background interference associated with the antenna.

Another aspect of the invention that is useable with one or more of the features of the above aspects discloses a method of forming a web material dispenser that includes providing a feed mechanism that is configured to dispense a web material from an enclosure. A controller is connected to the feed mechanism and a capacitive sensor is provided and configured to initiate operation of the feed mechanism in response to proximity detection of a user.

Various other features, aspects and advantages of the invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
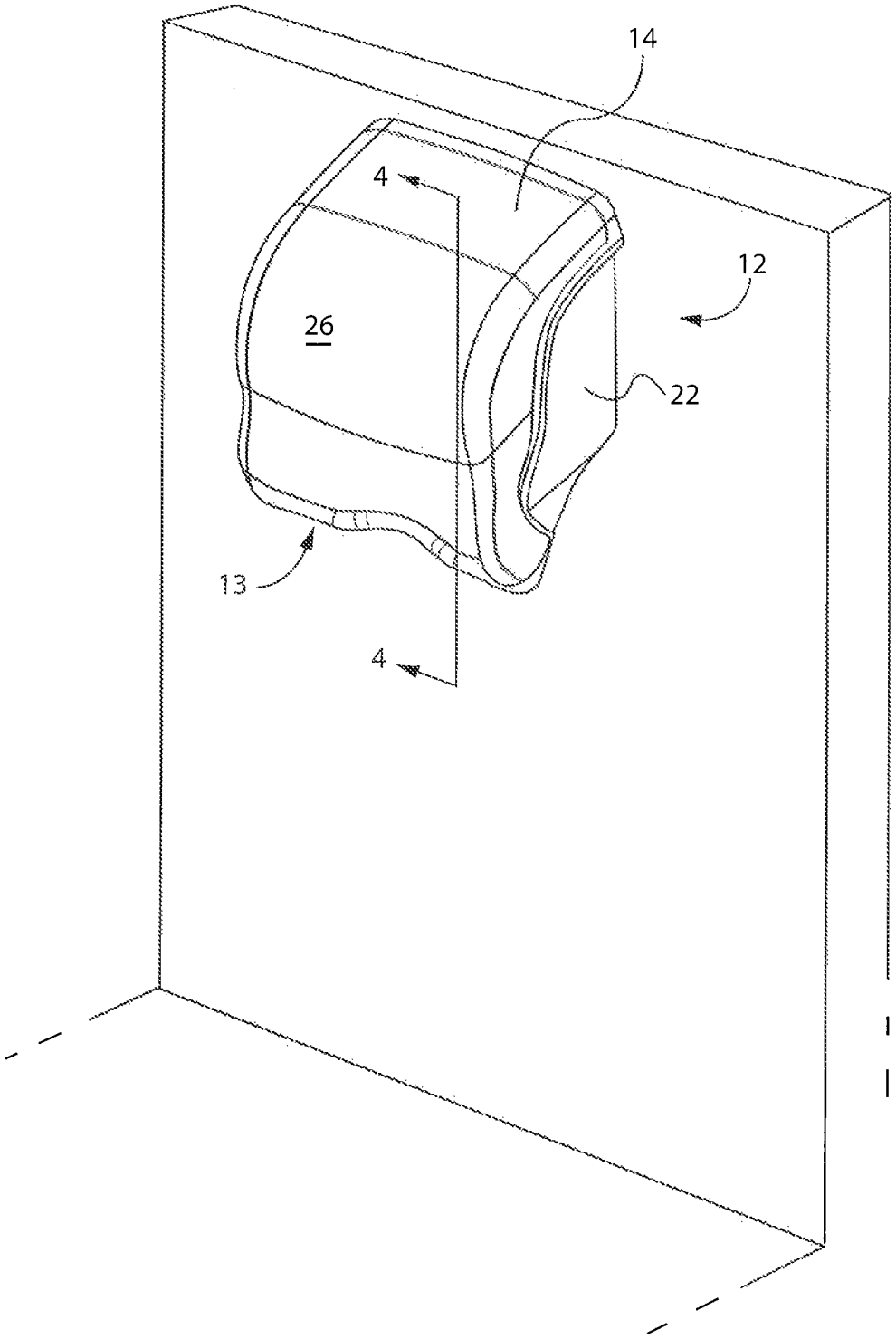
FIG. 1 is a perspective view of a contact-less dispenser according to the present invention.
Figure 2:
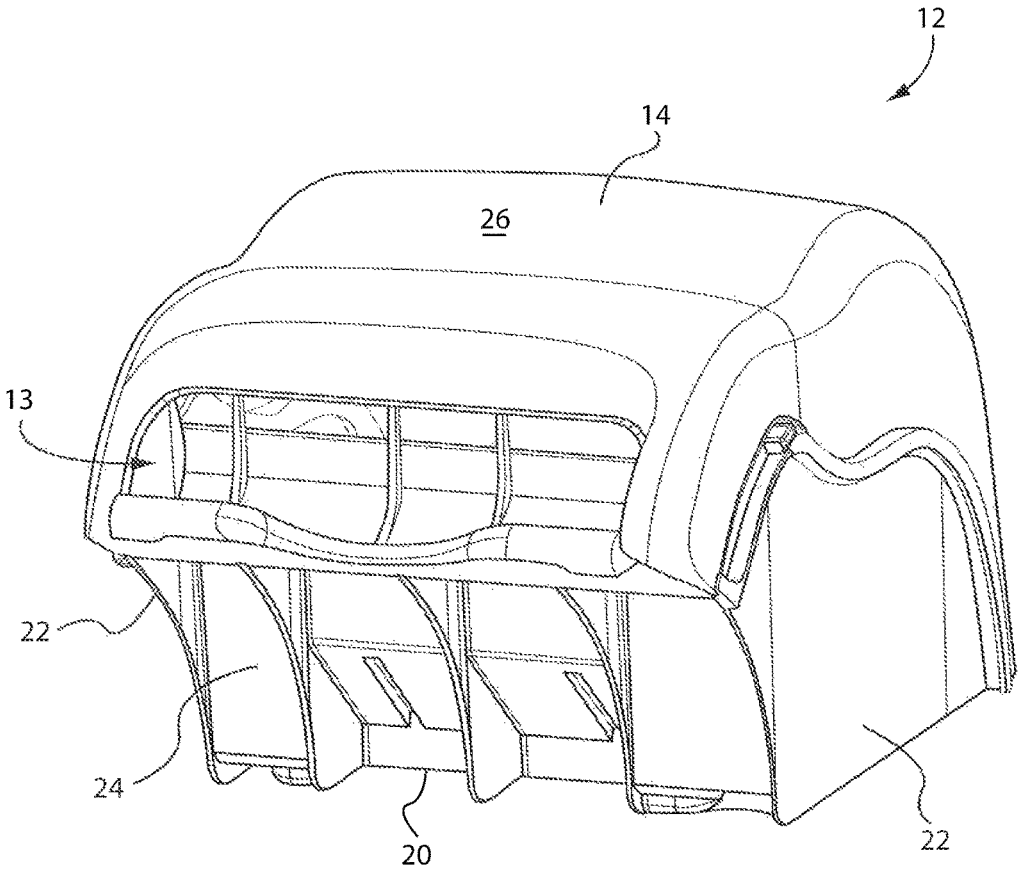
FIG. 2 is a perspective view of an underside of the roll dispenser shown in FIG. 1.

In describing the preferred embodiments of the invention which are illustrated in the drawings, specific terminology is resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF THE PREFERRED EMBODIMENT

FIG. 1 shows a dispenser 12 according to one embodiment of the present invention. As explained further below with respect to FIGS. 3-8, dispenser 12 includes a material advancement or feed mechanism that is configured to cause the roll dispenser to dispense an amount of a web material for use by the user and to do so in a manner that requires no direct physical interaction between the user and dispenser 12 aside from the user's removal and/or tearing of the dispensed web material from an opening or mouth 13 of dispenser 12 and/or the material roll.

Referring to FIGS. 1-4, dispenser 12 includes a housing or enclosure 14 that is shaped to receive a replaceable roll 16 of sheet or web material. Enclosure 14 is defined by a back or back wall 20, sidewalls 22, a floor 24 and a front cover 26 that cooperate with one another to define an interior cavity 28 of enclosure 14. Enclosure 14 may be formed of plastic or other suitable material. The back wall 20, sidewalls 22, and floor 24 collectively form a rear portion of enclosure 14. Cover 26 movably cooperates with the rear portion of enclosure 14 to selectively expose cavity 28 and the roll 16 of material associated therewith. It is appreciated that the portion of enclosure 14 that is generally rearward of cover 26 may be formed as a single or multiple piece assembly formed by injection, blow, or roto molding. Alternatively, the various walls or panels that define enclosure 14 may be separately manufactured parts that are connected by welds, moldings, fasteners, solder, or the like.

Figure 3A:
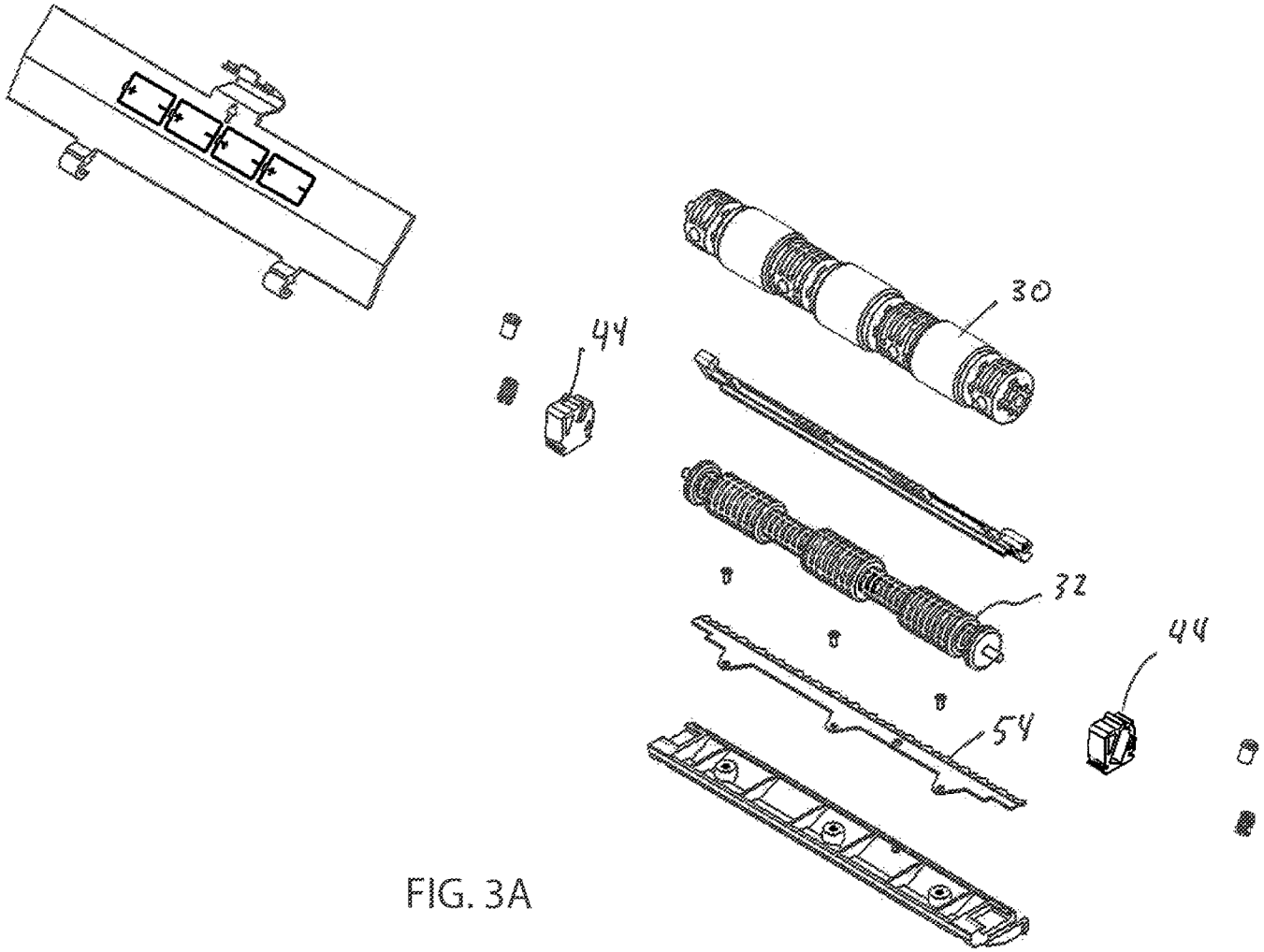
FIG. 3A-3C are perspective exploded views of the dispenser shown in FIG. 1.
Figure 3B:
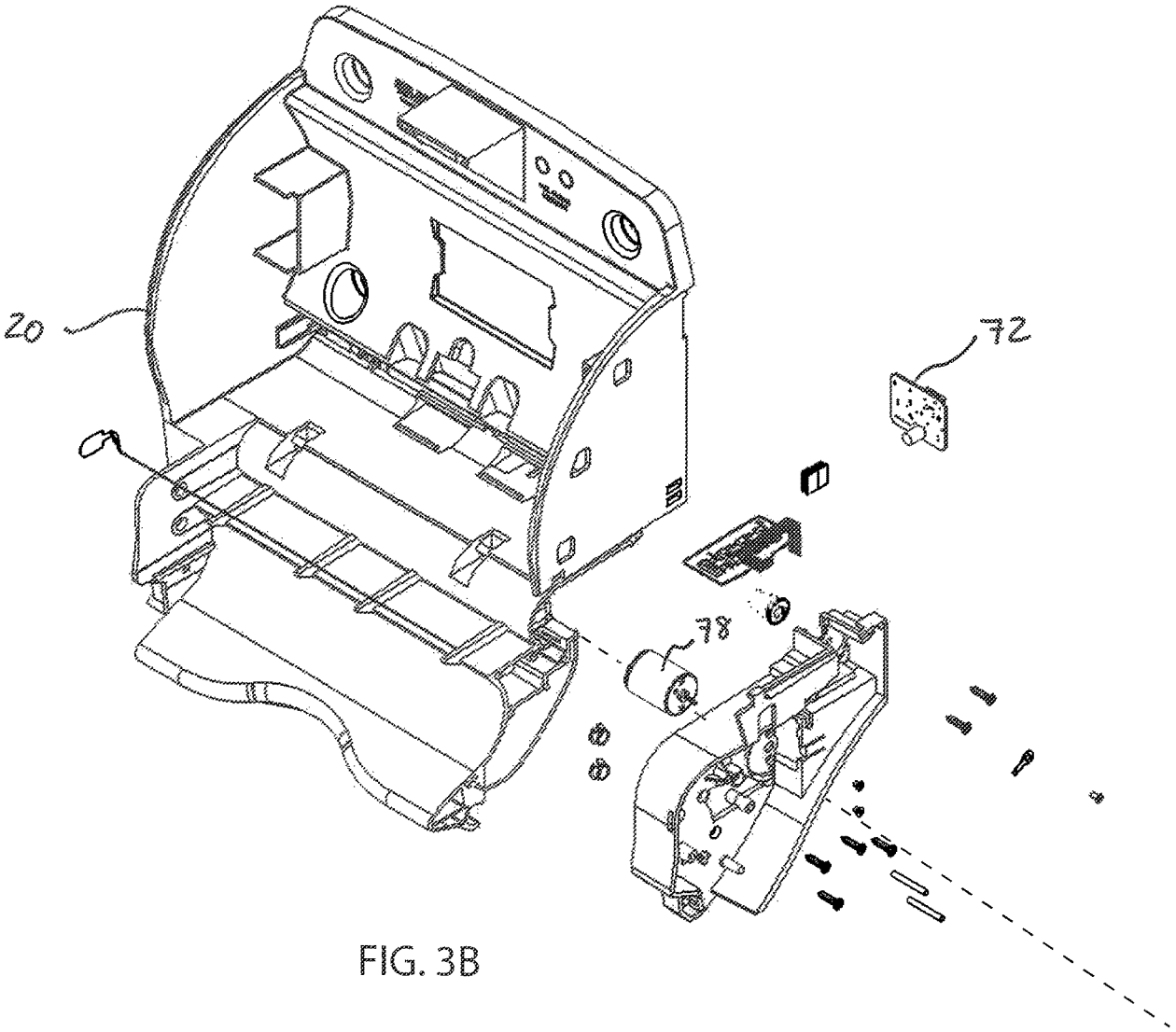
Figure 3C:
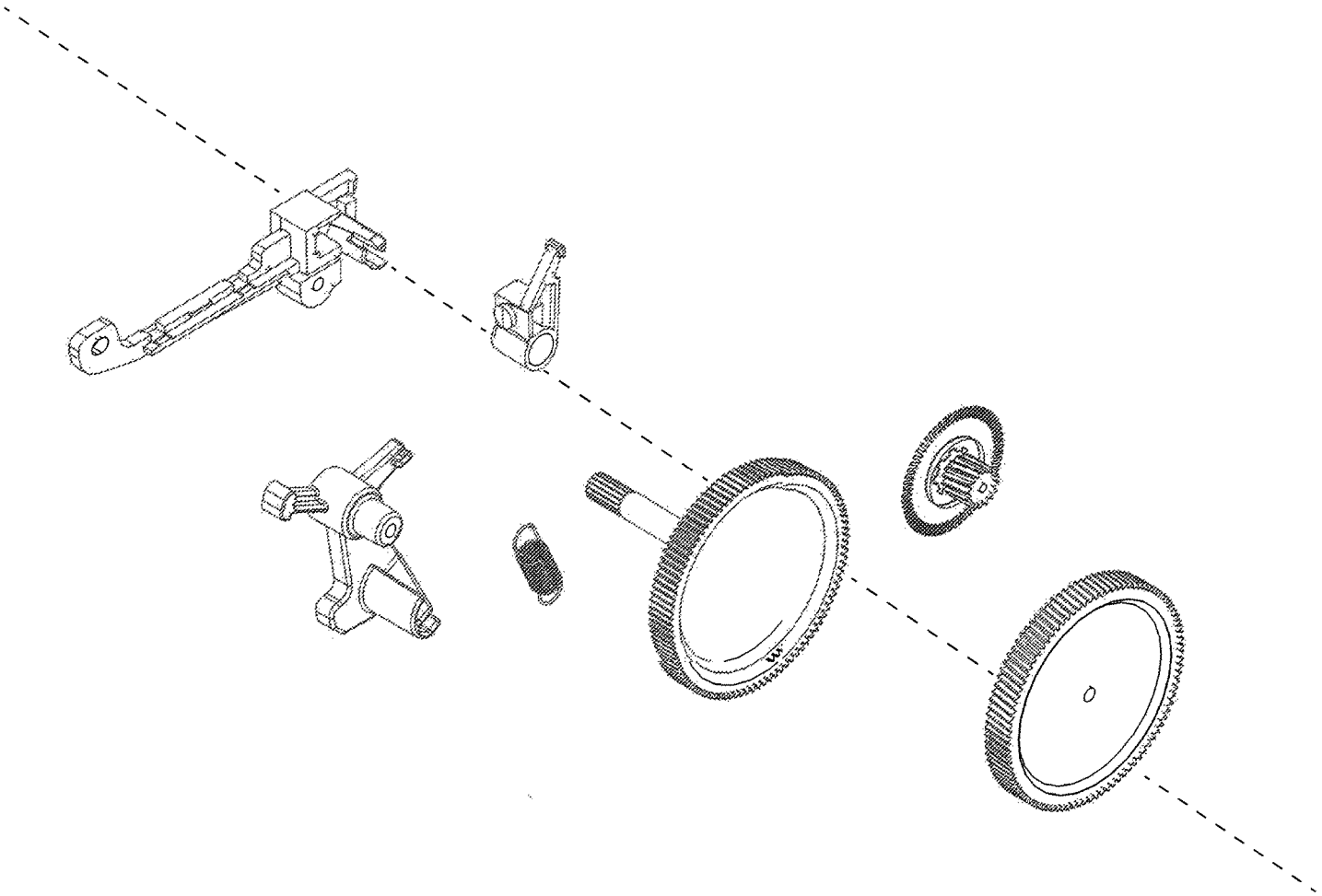
Figure 4:
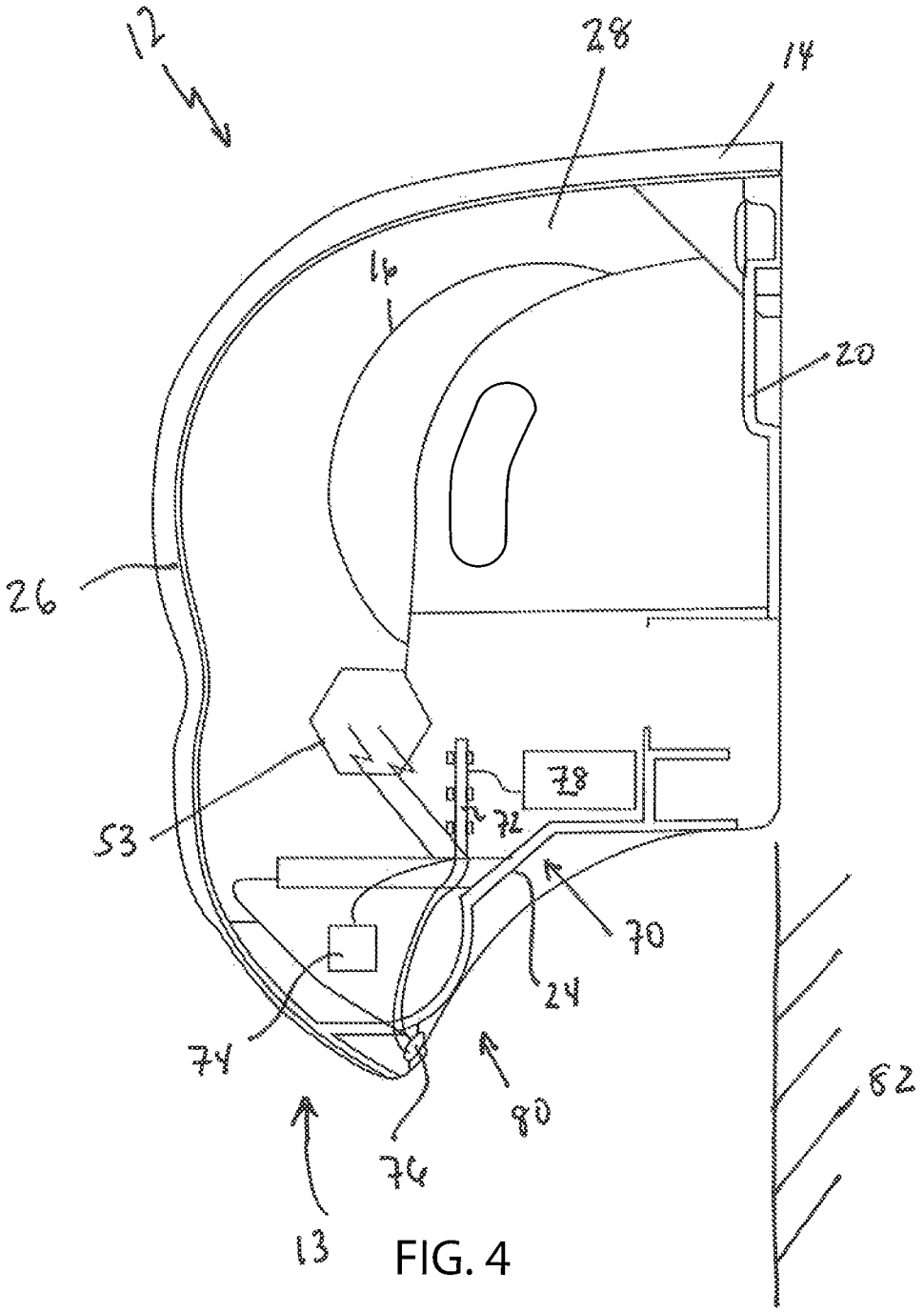
FIG. 4 is a cross section elevation view of the dispensing apparatus taken along line 4-4 shown in FIG. 1.

Referring to FIGS. 3 and 4, dispenser 12 includes a feeding, feed assembly or feed mechanism 29 that is contained within enclosure 14. Although shown as an assembly that cooperates with enclosure 14, it is appreciated that in other embodiments, the feed mechanism 29 can be provided in the form of a cassette that can be assembled prior to being associated with enclosure 14. Regardless of the specific configuration, feed mechanism 29 includes a drive roller 30 and an idle roller 32. The drive roller 30 and the idle roller 32 form a pressure nip 34 through which the material is drawn prior to being dispensed beyond the confines or perimeter edge of enclosure 14. The drive roller 30 and the idle roller 32 extend transversely with respect to and are supported from the sidewalls 22 of enclosure 14 for rotation about respective parallel axes 36, 38. It will be appreciated that these axes are also generally parallel to the rotational axis of the roll 16.

In one embodiment, the opposite ends of the drive roller 30 are journalled in a suitable manner so that axis 36 is fixed. As shown in FIG. 4, such journaling can be provided with a drive pin 42 and one or more bearing blocks 44. The opposite ends of idle roller 32 are mounted so that axis 38 is able to be moved towards and away from the axis 36 of the drive roller 30. The ends of the idle roller 32 are preferably spring biased to urge the idle roller 32 into engagement with the drive roller 30. As shown in FIG. 4, this may include a push-block or spring holder 46 and a spring-bearing block 48 that can be inserted into each of the bearing blocks 44. Alternatively, the idle roller 32 may be fixed and the drive roller 30 may be mounted so that the axis 36 of the drive roller 30 is biased towards the axis 38 of the idle roller 32. Regardless of which roller is moveable, the drive roller 30 may be positioned either above or below the idle roller 32.

The ability of one of the rollers to move allows the pressure nip 34 to accommodate a variety of thicknesses of material. Such ability allows the dispenser 12 to be easily used with cored and/or core-less roll materials. Core-less rolls commonly have a center formed of tightly wound material which is commonly referred to as a "cigarette." The cigarette will not unroll as does the outer portions of the roll. A section of material may be visible when the core-less roll is almost completely dispensed from the dispenser 12. A user may see this section and tug on it hoping to pull material from a dispenser. Doing so causes the cigarette to contact the drive roller and the idle roller. The rollers of traditional dispensers do not have the available travel to accommodate passage of the cigarette. As such, the cigarette can become jammed in the rollers. The present invention provides for sufficient travel between the drive roller 30 and idle roller 32 so that the cigarette can be easily passed through the pressure nip 34 by actuation of the feed mechanism 29.

The present invention can be constructed to provide for use of a feed mechanism 29 in the form of a cassette that can be assembled without the use of any tools or can be formed of a number of discrete parts that are configured to individually, or as sub-assemblies, cooperate with the interior structure of enclosure 14. In one embodiment, as shown in FIG. 4, opposite ends of the drive roller 30 and idle roller 32 are fit into respective bearing blocks 44. As described above, a drive pin 42 is used to secure the drive roller 30 into one of the bearing blocks 44. Spring holders 46 and spring bearing blocks 48 secure the idle roller 32 relative to the bearing blocks 44. The drive pin 42 engages the drive roller 30 and the bearing block 44. The drive pin 42 extends out from the bearing block 44 and engages an optional thumbwheel gear 50. The drive pin 42 also extends out from the thumbwheel gear 50 and a one-way clutch 52 is positioned onto the drive pin 42 thereby securing the thumbwheel gear 50 to the drive pin 42 and bearing block 44. A motor 53 engages clutch 52 and is secured to, enclosure 14 such that operation of motor 53 effectuates operation of drive roller 30. As explained further below, motor 53 is connected to a control system 70 of dispenser 12 that allows selective operation of motor 53 in response to detection of the hand of a user in proximity to the dispenser. It should be appreciated that motor 53 could be directly or indirectly engaged with feed roller 30 and/or be integrated into feed roller provided rotatable electrical contacts are provided. Regardless of the interaction, operation of motor 53 effectuates rotation of feed roller 30 and/or roll 16 to effectuate the dispensing operation but motor 53 does not inhibit manual advancement of roller 30 during service or restocking procedures and/or can be utilized to provide the desired operation of the feed roller during such activities.

The various parts of the feed mechanism may be formed of plastic or other suitable material. As shown in FIG. 3, a blade 54 also preferably cooperates with the bearing blocks 44. Hooks 58 are formed on opposite ends of the blade 54 and cooperate with charnels 60 formed in the inward facing sides of bearing blocks 44 so as to secure together the components of the feed mechanism cassette. It is appreciated that motor 53 may be engaged with the cassette or engaged with enclosure 14 in a manner wherein motor 53 operationally cooperates with the cassette when the cassette is engaged with the enclosure.

Once or as assembled, the feed mechanism may be fit into enclosure 14. Preferably, the various components of the feed mechanism are configured to cooperate with one another or with the structure of a cassette without the use of any tools. Traditional dispensers require inserting the parts that comprise the feed mechanism into a chassis, which is then inserted into the housing. In one embodiment, the cassette of the feed mechanism may be snap fit into enclosure 14 wherein each of the bearing blocks 44 matingly engages an insert or other boss or cavity formation located in the housing. Such direct mounting of the cassette of the feed mechanism 29 relative to enclosure 14 eliminates the need for an extraneous feed mechanism chassis. Eliminating the chassis reduces the number of pieces and amount of material required to construct dispenser 12 as well as the amount of time required to assemble each respective dispenser. Such reductions streamline the manufacturing process and lower production costs.

Preferably, feed mechanism 29 is configured to be easily removed from the housing with a screwdriver or other such small hand tool whether the feed mechanism includes motor 53 or motor 53 is independently engaged with enclosure 14. Such a configuration makes it simple and inexpensive to replace the entire feed mechanism and motor, only the driven parts of the feed mechanism, and/or only the motor associated with operation of the feed mechanism in the field and provides the ability to do so with little effort. Furthermore, such a construction minimizes the parts and the overall portion of the dispenser 12 that would need to be replaced should the dispenser require service or repair or otherwise be rendered inoperable via failure of any specific part and thereby reduces maintenance and/or service costs.

Figure 5:
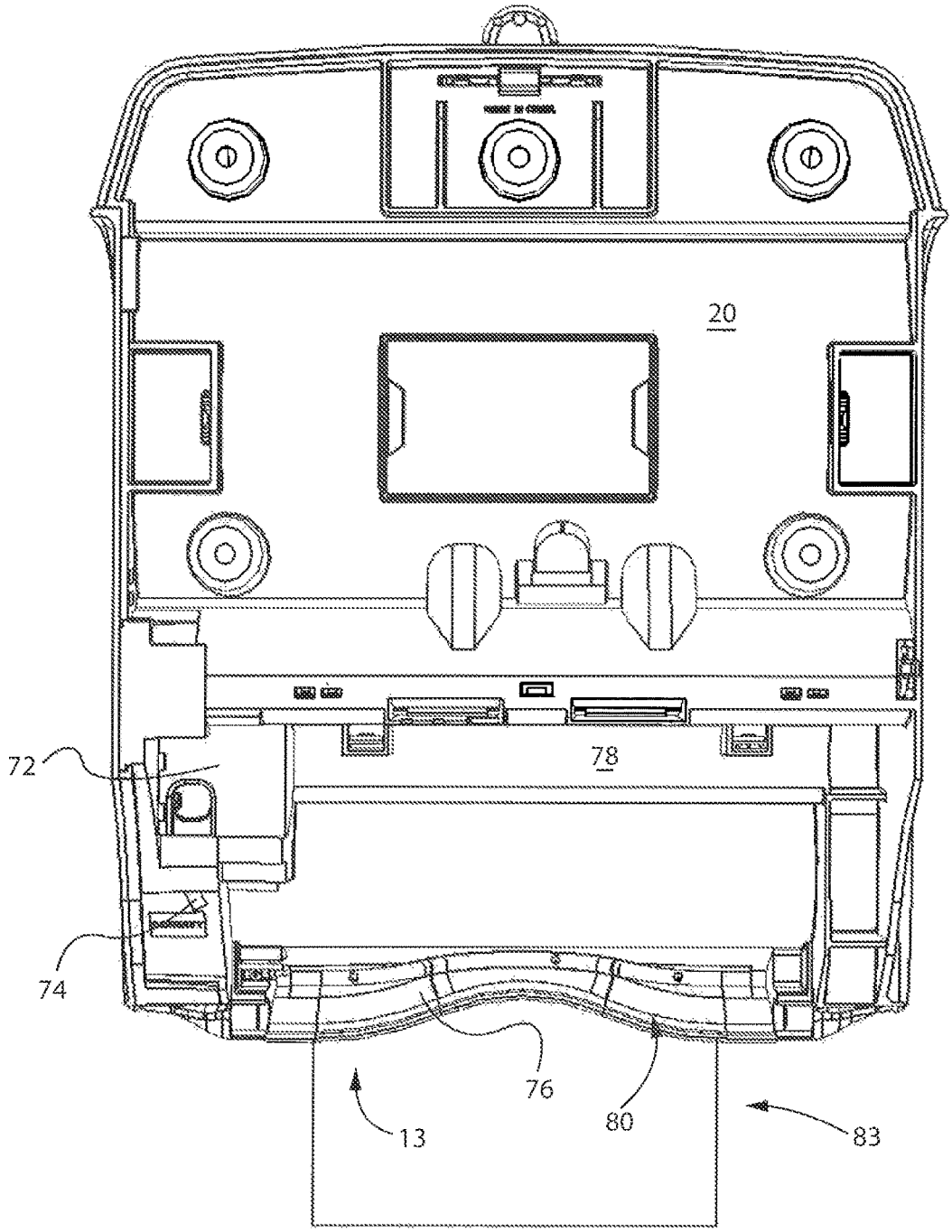
FIG. 5 is an elevation view of a rear of the dispenser shown in FIG. 1 and shows the sensor, antenna, and controller associated therewith.

As noted above, feed mechanism 29 is operationally connected to motor 53 and operation of motor 53 is initiated by a controller, control arrangement, or control system 70 having a circuit board 72 and a capacitive sensor formed by an antenna 76 connected to the control system 70. Dispenser 12 can include a power source 78, such as one or more batteries, or be configured to engage permanent wiring associated with a structure. Preferably, dispenser 12 is configured for operation with either utility power or an independent or discrete power source. Referring to FIGS. 4 and 5, in one embodiment of the invention, back wall 20 of dispenser 12 includes a cavity 80 that extends laterally across enclosure 14 generally behind mouth 13 associated with dispensing the material from the enclosure. Antenna 76 is disposed in cavity 80 and is preferably connected to a rear facing side of back wall 20 of enclosure 14. Preferably, antenna 76 is exposed to atmosphere and offset or spaced away from a wall 82 or other surface intended to support dispenser 12. Preferably, antenna 76 is offset from wall 82 a distance that leaves antenna 76 positioned between mouth 13 and wall 82 but at a location that is much nearer mouth 13. As explained further below, positioning antenna 76 in such a manner improves the repeatability of operation of dispenser 12 and positions antenna 76 very near the user's hand when the user is attempting to initiate operation of feed mechanism 29 and such that the dispensed material is directed directly into the hand of the user.

Figure 6:
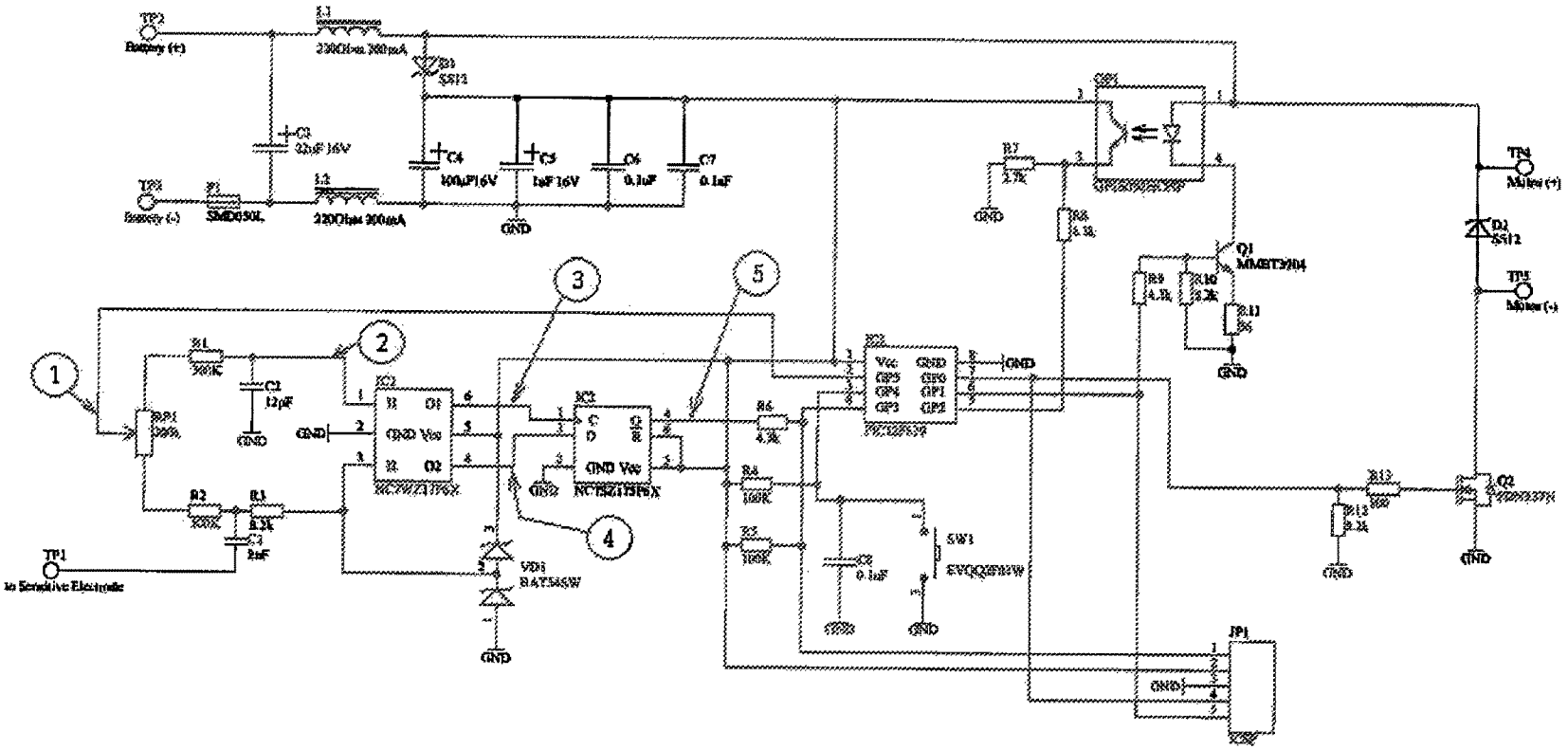
FIG. 6 is a schematic view of an exemplary circuit associated with operation of the dispenser shown in FIG. 1.

Referring to FIGS. 4-6, antenna 76 may take many forms. For example, the antenna 76 may be a wire or group of wires. Alternately, antenna 76 may comprise conductive paste or metal foil. Preferably, antenna 76 is provided as a stamped aluminum ribbon with a thickness of approximately 0.017 inches for consistency in manufacturing and product similarity between platforms. Regardless of form, it is preferred that the antenna 76 extend substantially along the majority of the lateral or horizontal length of the enclosure 14 and generally parallel to the long axis of mouth 13 of dispenser 12. Antenna 76 is operative to sense capacitive changes that occur within its sensing zone when an object, such as a user's hands, is moved into the sensing zone. When such a capacitive change occurs, circuit board 72 assesses the capacitive change associated with the signal of antenna 76 and controls operation of drive roller 30 or another feeding mechanism of the dispenser 12 to advance the roll material when the users hand moves into relative proximity to dispenser 12 but without directly contacting the dispenser.

It will thus be appreciated that in one embodiment of the invention, the capacitive sensor detects a user's hand(s) within a predefined sensing zone below and/or in front of the dispenser. The capacitive sensor provides feedback to control circuit or controller 72, such as a circuit board, motor controller, or microprocessor, to actuate motor-driven roller 30 to advance web material from roll 16 disposed within enclosure 14. Control system 70 can include a selector 74 configured to manipulate the sensitivity of antenna 76. Selector 74 could provide infinite adjustability of the sensitivity of antenna 76. Preferably, automatic sensitivity adjustment is incorporated into control system 70 to automatically manipulate the sensitivity of the operation of antenna 76 as a function of the capacitance of a background noise, such as wall 82, operation of motor 54, and other interference which may be attendant either the environment associated with implementation of the device and/or interferences associated with the intermit dispensing operations of the dispenser 12. Since a wall 82 formed of concrete and/or steel will have a higher capacitive interferences than a hollow core wall, commonly formed of timber and wallboard, sensitivity adjustment allows dispenser 12 to be configured for effective operation in any of a number of given environments.

The cooperation of control system 70 and the capacitive sensing of antenna 76 allows dispenser 12 to dispense web material from roll 16 contained within the enclosure 14 in a manner that requires no direct contact with the user and in a manner that eliminates a number of commonly more expensive electronic components associated with other such contact-less dispensing. Control system 70 eliminates the need for operational amplifiers, low pass filters, auto compensating capacitors, a detection means or circuit coupled to an operational amplifier, a diode based voltage peak detector, a gain and offset voltage amplifier, consideration of a variable time constant that is on the order of twice a fixed time constant when detecting the presence of a user, oscillators, and other commonly more costly components commonly utilized to provide the operational functionality of other contact-less dispenser systems.

Dispenser 12 is not required to detect a peak voltage, generate a low frequency detection signal component in response to low frequency changes in the antenna signal, requires no signal amplification, or manipulate the power signal input to the antenna sensor based as a function of the sensor signal length. Rather, antenna 76 senses the presentment of an object, such as a user's hand, within a sensing, proximity or detection zone 83 that is generally adjacent dispenser 12. In one preferred embodiment, the detection zone 83 is predominantly defined adjacent discharge opening or mouth 13 of dispenser 12. In one embodiment of the invention, mouth 13 is located so that dispensed roll material can be grasped by the user from a location below dispenser 12. Preferably, antenna 76 is positioned along mouth 13 so that detection zone 83 is generally located proximate an area a user would expect or anticipate the material to discharge from dispenser 12. For such a dispenser, the detection zone 83 would generally encompass a limited area below and in front of the dispenser although it is appreciated that dispenser 12 can be configured to allow operation associated with other detection zones. Preferably, detection zone 83, and thereby antenna 76, is located at a location that is offset from the support structure such as a wall associated with dispenser 12 and near or more proximate the opening from which a user would expect material to be dispensed. Such a configuration allows antenna 76 to be in close proximity to the area associated with the movement of the users hand in attempting to initiate the dispense operation.

Figure 7:
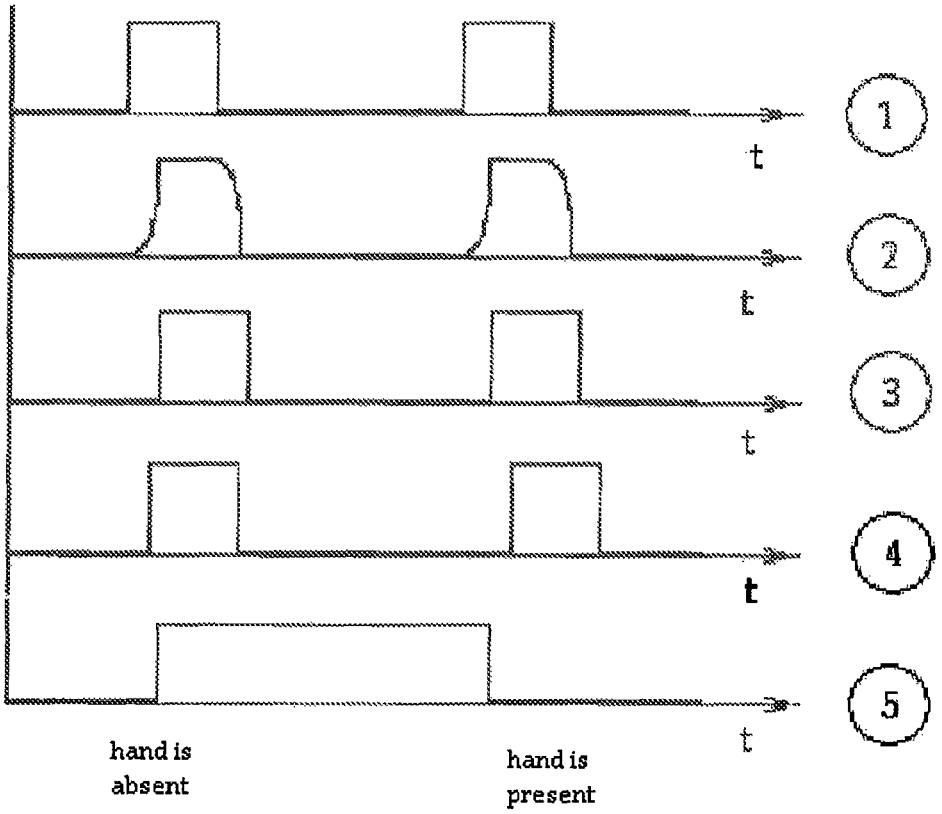
FIG. 7 shows various sensor signal trends associated with detecting the presence of a user of the dispenser shown in FIG. 1.

Referring to FIGS. 6-7, FIG. 6 shows an exemplary circuit associated with circuit board 72 of control system 70. Control system 70 is preferably configured as a microcontroller configured to generate square pulses at an interval period of approximately 20 ms and a duration of about 0.5 ms and which are applied to two integrating chains. The first integrating chain provides a fixed delay and comprising the part of the circuit associated with the top part of potentiometer RP1, resistor R1, and capacitor C2. The second integrating chain provides an alternate delay that comprises the bottom part of potentiometer RP1, resistor R2, and the capacity of the sensitive electrode, i.e. antenna 76. The signals output from the integrating chains are applied to the inputs of Schmitt triggers U1 that transform the slope of the input signal from an exponential form to a well-defined square wave form.

A time constant from the first chain is set to a value that is slightly less than the value of the second chain associated with the absence of a user hand being present in detection zone 83. A signal adjustor, such as a potentiometer RP1, is provided to set the necessary balance between the signals between the first chain and the second chain for when the user is and is not present in detection zone 83. In a preferred embodiment, RP1 is provided as a switch that provides only two discrete output values rather than an infinitely adjustable output value. Still referring to FIGS. 6 and 7, an output signal from a first Schmitt trigger is used as a clock signal for a D-type flip-flop and an output signal from a second Schmitt trigger provides a data signal. The respective signals 1-5 shown in FIG. 7 are associated with the discrete circuit locations 1-5 shown in FIG. 6 and the signal assessments as determined at locations 1-5 are indicative of either a user being present in detection zone 83, thereby indicating a dispense activity, or the absence of the presence of a user in detection zone 83.

Referring to FIGS. 6 and 7, it should be appreciated that, when detecting a hand, the variable time constant is simply greater than or equal to the fixed time constant such that the detection comparison is qualitative rather than quantitative as provided by other more complicated detection methodologies. As shown in FIG. 7, while the delay of the second integrating chain is shorter than a predefined constant delay of the first integrating chain, the rising slope of the clock signal comes later than the data signal associated with trend 1. Such an action allows the flip-flop to set the logic to a value of 1.0. If a hand is placed in detection zone 83 so as to interfere with the capacitance of antenna 76, the capacitance of antenna 76 increases and the delay associated with the second integrating chain becomes larger than the fixed value. The rising slope of the clock signal comes earlier than the slope of data signal one thereby allowing the flip-flop to toggle the logic signal to zero. Controller 70 detects the deviation or low level as an instruction or to start dispensing or instruct operation of motor 53 for a selected duration. Alternatively, controller 70 could be configured to simply suspend operation of motor 53 upon recovery of the flip-flop logic signal to a value of one indicative of a non-presence of a user hand in detection zone 83. Preferably, blade 54 is configured to initiate the discharge suspension or end of cycle instruction. Dispenser 12 can include one or more of a linkage connected to the controller or an electronic sensor connected to the controller and configured to provide the termination signal. Regardless of the methodology and modality of the dispensing termination signal, each of the above operational sequences provide dispensing of only a desired amount of the web material.

It should be further appreciated that the background interference discussed above can manipulate and/or interfere with the desired operation of antenna 76 and/or dispenser 12. When background interference is too high, selector 74 can be manipulated to reduce the sensitivity associated with the operation of antenna 76. Lowering the sensitivity of the operation of antenna 76 to a more tolerable value conserves energy associated with the antenna's operation. As noted above, rather than providing a manually operable selector 74, controller 70 can be configured to periodically assess the capacitance of the background environment and manipulate operation of antenna 76 in response to the detected background. Such a configuration preferably includes a variable digital resistor having a value set by controller 72. Controller 72 assesses the background interference rate via interaction with antenna 76 and the resistor and sets the sensitivity of the system as a function of the assessed value.

It should be further appreciated that positioning antenna 76 outside enclosure 14 and offset from wall 82 reduces the undesired interaction of the background capacitance with the desired detection of a user's hand in proximity to antenna 76. It can be further appreciated that the capacitance associated with operation of the antenna could also be manipulated by providing multiple alternate antenna locations relative to enclosure 14 and relative to wall 82. That is, moving the antenna further from wall 82 would limit the capacitive interference to which antenna 76 is subjected as a result of its proximity to wall 82. It is appreciated that such manipulation of antenna 76 could be provided without removing enclosure 14 from wall 82 and that enclosure 14 could be provided with multiple alternate bosses and/or cavities configured to cooperate with antenna 76. Each of the methodologies above would allow the user to uniquely configure the capacitive sensor so that the dispenser can accommodate different extraneous limitations associated with implementation of the device rather than any of the operational limitations intrinsic to the construction and operation of dispenser 12. Such a construction provides both an economical as well as highly versatile web material dispenser.

From the foregoing description, it can be seen that dispenser 12 provides a powered web material dispenser that can be economically constructed and allows hands-free operation of the dispenser 12. It should be further appreciated that the operability of dispenser 12 can be manipulated to tolerate differences in the environment associated with used of the dispenser. Dispenser 12 can be made from inexpensive, but durable materials such as plastic by injection, blow, or roto molding and/or other conventional methods and is configured to allow convenient replacement of the rolled material as well as visual inspection as to the status of the amount of roll material associated with the device, the device is unobtrusive and aesthetically appealing, can dispense lower tensile strength material without tearing, and can dispense cored or core-less material equally well without modification or installation of additional parts.

The dispenser of the present invention may have other applications aside from use in paper towel rolls and paper toweling. Although the invention has been herein shown and described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims. The present invention has been described in terms of the preferred embodiment, and it is recognized that equivalents, alternatives and modifications, aside from those expressly stated, are possible and within the scope of the appending claims. It will be appreciated that the present invention provides a low-cost, hands-free sensor enabled dispenser that provides the functionality of conventional hands-free or contactless dispensers without the higher costs typically associated therewith.

We claim:

1. A dispenser assembly comprising:

an enclosure adapted to hold a supply of web material, the enclosure having an opening through which web material is dispensed;

a capacitive sensor comprising an antenna wherein the antenna is directly supported by and disposed outside the enclosure and located and having a sensing zone proximate the opening and operative to detect movement of an object within the sensing zone;

a drive mechanism operative to advance web material when the capacitive sensor detects movement of an object within the sensing zone; and a circuit board operationally connected to the antenna and configured to effectuate operation of the drive mechanism when the capacitive sensor detects movement of an object within the sensing zone and wherein the circuit board is located at a position that is offset from the capacitive sensor.

2. The dispenser assembly of claim 1 further comprising a cavity that is exposed to atmosphere formed in the enclosure proximate the opening, the cavity extending in a horizontal direction.

3. The dispenser assembly of claim 2 wherein the antenna is disposed in the cavity and secured to the enclosure to be offset from a perimeter edge of the enclosure and offset from a rear wall of the enclosure.

4. The dispenser assembly of claim 3 wherein the antenna extends a majority of a length of the cavity in the horizontal direction and is formed of aluminum material and is 0.017 mm thick.

5. The dispenser assembly of claim 1 further comprising a selector that is operable to manipulate sensitivity of the capacitive sensor.

6. The dispenser assembly of claim 1 further comprising a digital resistor configured to assess background interference and manipulate operation of the capacitive sensor in response the background interference.

7. The dispenser of claim 6 wherein the background interference includes capacitive interference of adjacent structures and operating equipment.

8. The dispenser assembly of claim 6 wherein the digital resistor automatically manipulates operation of the capacitive sensor in response to changes in background interference.

9. A web material dispenser comprising:

an enclosure;

a feed mechanism contained in the enclosure and configured to cooperate with a roll of a material such that operation of the feed mechanism dispenses the material beyond the enclosure;

an antenna supported by and disposed outside the enclosure, the antenna being shaped to cooperate with a cavity defined by the enclosure such that the antenna is supported by cooperation of the antenna with the cavity defined by the enclosure; and a control that is offset from the antenna and is independently supported by the enclosure and operationally connected to the antenna and configured to manipulate sensitivity of a signal associated with the antenna as a function of background interference with the signal associated with the antenna.

10. The web material dispenser of claim 9 wherein the antenna is further defined as an elongate ribbon.

11. The web material dispenser of claim 10 wherein the antenna extends in a generally horizontal orientation and is not isolated from atmosphere by the enclosure.

12. The web material dispenser of claim 11 wherein the cavity that supports the antenna faces a rearward direction relative to an operating orientation of the dispenser and is disposed proximate a mouth defined by the enclosure and from which the material dispenses directly into a hand of a user.

13. The web material dispenser of claim 9 wherein the control is configured to manipulate the function of background interference with the antenna based at least one of the material of a wall which supports the dispenser and operation of equipment internal or external to the enclosure.

14. The web material dispenser of claim 13 wherein the control includes a bidirectional selector that determines the function.

15. The web material dispenser of claim 9 wherein the antenna is formed of stamped aluminum material.

16. The web material dispenser of claim 9 wherein the control includes a flip-flop to designate a dispense condition.

17. The web material dispenser of claim 16, wherein the control periodically assesses background interference.

18. The web material dispenser of claim 16 wherein the control is configured to dispense material when a signal output from the flip-flop is greater than 1.0.

19. A method of forming a web material dispenser, the method comprising:

providing a feed mechanism that is configured to dispense web material from an enclosure;

connecting a controller to the feed mechanism; and providing a capacitive sensor formed as an elongate antenna that is operationally connected to the controller and supported by and disposed outside the enclosure at a location in a cavity in the enclosure and remote from the controller such that the controller and elongate antenna are independently supported by the enclosure and configured to initiate operation of the feed mechanism in response to proximity detection of a user.

20. The method of claim 19 further comprising disposing the elongate antenna outside a housing associated with the feed mechanism.

21. The method of claim 20 further comprising orienting the elongate antenna near a mouth associated with dispensing the web material from the enclosure.

22. The method of claim 19 further comprising providing an adjustor connected to the controller for adjusting a sensitivity associated with operation of the elongate antenna.

23. The method of claim 22 wherein the adjustor provides more than one preset wherein each preset is associated with a different background capacitance.

24. The method of claim 19 further comprising providing a diode associated with filtering noise associated with operation of the capacitive sensor.

25. The method of claim 24 further comprising providing a flip-flop wherein an output signal having a value greater than 1.0 associated with the flip-flop results in a dispense operation.

* * * * *